US009731929B2

(12) United States Patent
Hoffmann

(10) Patent No.: US 9,731,929 B2
(45) Date of Patent: Aug. 15, 2017

(54) METHOD FOR DETERMINING THE WINDING QUALITY OF A FILM ROLL

(71) Applicant: Windmöller & Hölscher KG, Lengerich (DE)

(72) Inventor: Frank Hoffmann, Haltern am See (DE)

(73) Assignee: Windmöller & Hölscher KG, Lengerich (DE)

( * ) Notice: Subject to any disclaimer, the term of this patent is extended or adjusted under 35 U.S.C. 154(b) by 107 days.

(21) Appl. No.: 14/441,889

(22) PCT Filed: Sep. 26, 2013

(86) PCT No.: PCT/EP2013/070058

§ 371 (c)(1),
(2) Date: May 11, 2015

(87) PCT Pub. No.: WO2014/072122

PCT Pub. Date: May 15, 2014

(65) Prior Publication Data

US 2015/0284211 A1 Oct. 8, 2015

(30) Foreign Application Priority Data

Nov. 9, 2012 (DE) ..... 10 2012 110 790

(51) Int. Cl.
*B65H 43/00* (2006.01)
*B65H 18/26* (2006.01)

(52) U.S. Cl.
CPC ..... *B65H 43/00* (2013.01); *B65H 18/26* (2013.01); *B65H 2511/10* (2013.01);
(Continued)

(58) Field of Classification Search
CPC ... B65H 43/00; B65H 18/26; B65H 2515/314
See application file for complete search history.

(56) References Cited

U.S. PATENT DOCUMENTS 4,817,883 A * 4/1989 Hoffmann ..... B65H 18/20 242/534
6,089,496 A * 7/2000 Dorfel ..... B65H 18/00 242/413.1

(Continued)

FOREIGN PATENT DOCUMENTS

CN 101289146 10/2008
CN 201753214 3/2011

(Continued)

OTHER PUBLICATIONS

Pruefungsantrag [Request for Examination] Dated Jun. 25, 2015 From the Deutsches Patent- and Markenamt [German Patent and Trademark Office] Re. Application No. 102012110790.4.

(Continued)

*Primary Examiner* — Sang Kim

(57) ABSTRACT

Method for the determination of the winder quality of a film roll (10) of a film (30) on a winder roller (20) comprising the following steps:

determination of the roll hardness (WH) of the film roll (10) during the winding on of the film (30) on the winder roller (20), determination of a variation from the determined roll hardness (WH) of the film roll (10) from at least one standard value (V1, V2) for the roll hardness (WH) of the film roll (10), determination of the film roll (10) using the determined variation.

14 Claims, 3 Drawing Sheets

(52) U.S. Cl.
CPC .... *B65H 2515/12* (2013.01); *B65H 2515/312* (2013.01); *B65H 2515/314* (2013.01); *B65H 2515/81* (2013.01); *B65H 2515/84* (2013.01); *B65H 2553/30* (2013.01); *B65H 2553/40* (2013.01); *B65H 2553/41* (2013.01)

(56) References Cited

U.S. PATENT DOCUMENTS

| | | | | |
|---|---|---|---|---|
| 6,209,817 | B1 * | 4/2001 | Conrad | B65H 18/26 242/413 |
| 6,494,399 | B1 | 12/2002 | Rautakorpi | |
| 2008/0017341 | A1 | 1/2008 | Maenpaa et al. | |

FOREIGN PATENT DOCUMENTS

| | | |
|---|---|---|
| CN | 102099754 | 6/2011 |
| CN | 202156805 | 3/2012 |
| DE | 8310005 | 7/1983 |
| DE | 4116081 | 11/1992 |
| DE | 4128706 | 3/1993 |
| DE | 9216261 | 2/1994 |
| DE | 19604652 | 8/1997 |
| DE | 19819276 | 11/1999 |
| DE | 19851483 | 5/2000 |
| DE | 19946400 | 4/2001 |
| DE | 10019497 | 10/2001 |
| DE | 10147127 | 1/2003 |
| DE | 10215197 | 10/2003 |
| DE | 10218509 | 11/2003 |
| DE | 10342210 | 4/2005 |
| EP | 0593946 | 4/1994 |
| EP | 0953531 | 11/1999 |
| EP | 1000892 | 5/2000 |
| EP | 1067072 | 1/2001 |
| EP | 1088779 | 4/2001 |
| EP | 1514817 | 3/2005 |
| JP | 2008-230826 | 10/2008 |
| WO | WO 2010/022772 | 3/2010 |
| WO | WO 2014/072122 | 5/2014 |

OTHER PUBLICATIONS

International Preliminary Report on Patentability Dated Mar. 19, 2015 From the European Patent Office Re. Application No. PCT/EP2013/070058.

International Search Report and the Written Opinion Dated Jan. 17, 2014 From the European Patent Office Re. Application No. PCT/EP2013/070058 and Its Translation of ISR in English.

Pruefungsantrag [Request for Examination] Dated Apr. 22, 2013 From the Deutsches Patent- and Markenamt [German Patent and Trademark Office] Re. Application No. 102012110790.4.

Office Action and Search Report Dated Jun. 1, 2016 From the State Intellectual Property Office of the People's Republic of China Re. Application No. 201380054252.6 and Its Translation of Office Action Into English.

* cited by examiner

METHOD FOR DETERMINING THE WINDING QUALITY OF A FILM ROLL

RELATED APPLICATIONS

This application is a National Phase of PCT Patent Application No. PCT/EP2013/070058 having International filing date of Sep. 26, 2013, which claims the benefit of priority of German Patent Application No. 10 2012 110 790.4 filed on Nov. 9, 2012. The contents of the above applications are all incorporated by reference as if fully set forth herein in their entirety.

FIELD AND BACKGROUND OF THE INVENTION

The present invention relates to a method for determining the winder quality of a film roll of a film on a winder roller and a monitoring device for monitoring the winder quality of a film roll of a film on a winder roller.

It is basically known that films are wound up subsequent to their production. The winding up occurs normally to a winder roller so that a so called film roll results on the winder roller. During the winding on certain parameter are essential. Thus, a winding on often occurs with inclusions of an air gap between the layers. Between the single layers of the film on the film roller air is inserted during the winding on so that an air gap or an air cushion develops between the single layers of the film in the film roll. The thickness of this air cushion influences the flexibility and therewith the softness of the whole film roller. This flexibility can also be described as winder quality. Particularly, this winder quality is crucial for the downstream further processing as for example the winding up of the film roll for the further processing. The further processing can for example be the printing of the film or the filling of for example a tubular bag. Thereby, particularly a defined winder quality is an advantage, which is determined within certain limits, thus above or below of standard values in a standard area.

It has already been proposed that the winder quality is monitored. For monitoring the winder quality basically two parameters from the state of the art are known. On the one hand it is known that the winder density is monitored, this occurs normally by a calculation or a counting of the running winding on process. Such a method is for example described in DE 41 16 081 A1. Disadvantageously with this determination of the winder density however a high calculative regulation effort and the plurality of different operating parameters, which have to be continuously monitored is necessary. From this indirect calculation of the winder thickness overall a higher inaccuracy occurs by the determination of the winder quality. Beneath the winder thickness it is also known that the roll hardness makes a statement about the winder quality of the film roller. It has been for example explained in DE 83 10 005 that the roll hardness can be determined as a dimension for the winder quality. A disadvantage with the previous determination of the roll hardness is however that this can only be performed subsequent to the termination of the winding on process. In this described DE 83 10 005 herefore a plurality of paper tapes is also wound on during the winding on process. After termination of the winding on process a conclusion to the roll hardness can be made by the measurement of the force during the extraction of these single paper tapes. At this point of time however the winding on process is already completed. Possibly, too strong or too soft winding on and accordingly a poor winder quality beyond the standard values is therewith only recognized at a point of time at which no regulation or intervention in the winding on is possible. This winder accordingly comprises a bad quality and can only be delivered with reduced prices or not at all with the further processing.

Beneath the reversion of the film wrap also the sum profile regulation for film rolls is known from DE 36 31 503 in order to generate an even winder quality over the width of the film roll. The therein described regulation however does not respect the compensatory characteristics of the air film between the film layers so that the film profile is unnecessarily strong influenced.

SUMMARY OF THE INVENTION

It is the object of the present invention to at least partially eliminate previously described disadvantages. Particularly, it is the object of the present invention to reduce the probability of false winding processes and accordingly of film rolls with inferior winder quality.

The previous object is solved by a method with the features of claim 1 and a monitoring device with the features of claim 12. Further features and details of the invention result from the depending claims, the description and the drawings. Thereby features and details, which are described in connection with the method according to the invention naturally apply also in connection with the monitoring device according to the invention and vice versa, so that according to the disclosure to the single aspects of the invention it can always be reciprocally referred to.

A method according to the invention serves for the determination of the winder quality of a film roll of a film of a winder roller. Such a method according to the invention comprises the following steps:

- determination of the roll hardness of the film roll during the winding on of the film on the winder roll,
- determination of a variation of the determined roll hardness of the film roll of at least one standard value for the roll hardness of the film roll,
- determination of the winder quality of the film roll by means of a certain variation.

As a measure for the winder quality the roll hardness is used also by means of the present invention. The central idea of the present invention is thereby the monitoring of the roll hardness and the corresponding determination of the roll hardness already during the wound up. In contrast to known measurement methods in this way, it is possible that already during the winding on process the actual winder quality can be determined and accordingly a prediction for the to be achieved winder quality after completion of the wound up process can be made. If the determined roll hardness is altered and falls out of the desired standard area, meaning exceeds one or multiple standard values, it can be interfered by a corresponding orientation. This can be a simple stop of the winding device and a manual readjustment by operating personal. Single operating parameters of the winding on process can be altered manually, semi automatically or even full automatically on the basis of the feedback about the winder quality from the method according to the invention. Thereby it is avoided that a film roll is completely provided with a cheap winder quality. Rather an intervention can prematurely be performed so that the generated film roll has with a higher probability a sufficiently good winder quality.

The winder quality of a film roll is particularly regarded according to adjusting defects. Possible reductions of the winder quality are for example a too soft winding on which can lead to the so called telescoping of the film roll. This means that with too soft film rolls the single layers can be moved relative to one another. In axial direction of the film roll thereby a telescope-like movement and extension of the single film layers can occur. This has to be mandatorily avoided since otherwise a further processing of the film roll by winding up this film rolls is only complicated or not possible anymore.

By a bad winder quality also so called compress pocks or compression rings can occur. By compression pocks mainly point-like air inclusions between different layers of the film have to be understood, which are reflected in local over stretchings or local increased tense situations within the film. This can lead to a damage up to a destruction of the film in the respective position. Compression rings result particularly from different film thicknesses. The compression rings can also be monitored or even avoided by a corresponding detailed awareness about the roll hardness and correspondingly the occurring winder quality. In an ideal manner other actions like for example the reversing of the film subsequent to the winding on by a method according to the invention can be resigned. Thereby particularly a possibility of the reaction of the profile control of the construction is available. This leads to distinct cost savings and the reduction of the complexity of the associated machines.

With the determination of the roll hardness of the film roll preferably a continuous monitoring during the whole winding on process occurs. Thereby, naturally the complete whole roll hardness based on the winder roll to the outermost film layer of the film roll can be monitored. Easier and cost-efficient is however when the outermost layers particularly the two outermost layers of the film of the film roller are monitored concerning the roll hardness. If this happens in discrete time intervals or even continuously or semi continuously a conclusion can be made to already further internal film layers and the intermediate air layers. Thereby, a mainly complete profile of the roll hardness over the whole radial cross section of the film roll can be established in a cost-efficient and simple manner. Also complex roll hardness processes, meaning not constant roll hardness over the radial process of the film roll, are thereby determinable or even adjustable by the use for the regulation of operating parameters.

According to the invention the determination of the roll hardness occurs particularly in a direct manner at the film roll. This means that no conversion for example of a monitored web tension force needs to occur. Rather during the determination of the roll hardness the corresponding parameter value is provided in a direct manner. Sources of error from an indirect monitoring are in this manner simply and cost-efficiently avoided. This direct determination of the roll hardness according to the invention can be simplified in a way that only for the outermost layer of the film roll particularly only for the two outermost layers the determination of the roll hardness occurs. Thereby, the effort of the monitoring and the complexity of the sensor system is reduced. Also the velocity of the determination is increased so that the monitoring can occur during the running winding operation. Thereby, it has to be indicated that the outermost layers of film roll are referring to the particular time point of the winding process. This means that the outermost layer for which the determination of the roll hardness occurs refers not to the explicit sections of the film roll but rather to the particular layer at the outside of the film roll. The outermost layers of the film roll thereby are the radially outermost layers of the film roll in a particular time point.

Another central idea of the present invention is the performance of the method already during the winding. Thereby, as another part of the method an influence can be made on the winding parameters of the winding process or the winding process can be even completely stopped. With other words in this manner according to the invention so to say a servo loop with the roll hardness of the winder roll can be provided as an input value like it is subsequently described.

A method according to the invention is particularly applied with films, for example plastic films. It can be applied for example with the winding on at the end of a so called film extrusion construction, particularly a blown film extrusion construction. Naturally, a method according to the invention can also be utilized in other areas of operation for example with the winding on of film-like or paper-like print products.

A method according to the invention is particularly practicable from a monitoring device. This can be provided with a control device, which performs the method according to the invention with a corresponding monitoring device.

The method according the invention can be further developed in a way that at least the step of determining the roll hardness of the film roll particularly also the further steps of the method occur continuously or mainly continuously. This step of determining the roll hardness can thereby be performed in cost-efficient way. Thus it is sufficient that the outermost film layer of the film roll at least the two outer most layers are monitored concerning the roll hardness. Thereby, a continuous or mainly continuous monitoring results in circumferential direction over the development which can be converted in a simple and cost-efficient manner to the radial development of the roll hardness over the radial extension of the film roll. Thereby, cost-efficient and simple sensors can be applied. The continuous or mainly continuous determination further serves for a simple practicability of the particular film quality for a regulation of the whole device. Particularly, therewith a control path can be provided which uses for the regulation of operation parameters of a winding on device as an input parameter the deviation or determined winder quality. Thereby, not only a warning with degraded winder quality, but also an intervention in the winding on process can occur. The target of this intervention is to restore the winder quality in the standard area meaning to restore the desired correlation to at least one standard value.

Likewise, it can be an advantage if with the method according to the invention the step of determining the roll hardness of the film roll during the winding on is performed contact-free. A contact-free measurement implies essential advantages since the sensor technology can be assembled small and spaced apart from the surface of the outermost film layer of the film roll. Likewise a contact-free measurement method will reduce the influence on the film to a minimum. Friction and vibration between the sensor device for determining the roll hardness and the respective film surface can in this manner be mainly completely avoided. Further the contact-free measurement can preferably permit a minor dependence from the distance between the associated sensor device and the surface of the film. Due to the fact that the diameter of the film roll increases over the course of the winding on process the reduction of the dependence of the distance to the sensor device can permit a simplified assembly of the sensor device. This leads to a reduction of complexity particularly for necessary tracking mechanism of the sensor device for performing the method according to the invention.

It can be further an advantage when the step determining the roll hardness of the film roll with the method according to the invention is performed during the winding on with the use of at least one of the following methods:

ultra sonic measurement laser measurement measurement with radar, micro, terahertz waves contacting track roller or ball From the previously non terminating list particularly measurement methods are preferred, which can contactlessly perform the determination of the roll hardness. Particularly, this is an ultra sonic measurement, which can perform a determination of the roll hardness via determination of the feedback of the ultra sonic signal. Also the utilization of laser measurement technique can perform a corresponding determination of the roll hardness by manner, likewise quality and/or quantity of the feedback of the laser signal. Radar measurement can in the same manner be performed contactless. Likewise a contacting track roller is a particularly cost-efficient possibility in order to perform a method according to the invention concerning the determination of the roll hardness. However here a contact method is provided which can be performed significantly more cost-efficient compared to a contactless method.

It is further possible that with a method according to the invention at least two standard values as upper standard value and as slower standard value define a standard area. Thereby, it has to be understood that the roll hardness concerning the winder quality gets provided a target range. In this target range as a standard area the roll hardness should be located in order to achieve a winder quality of the film roll in a likewise corresponding standard area. This means that the winder quality should be not too stiff and not too soft. A too stiff winder quality could lead to a damage of the film during the winding on for example by compression rings or winding pocks. A too soft winder quality could lead to the previously described problems of telescoping or further winding defects. The target of at least two standard values which define a standard area permits therewith a narrowed quality standard, which can lead to an increased winder quality according to the invention during the performance of the method according to the invention. Deviations from the standard area are particularly used for the regulation of operations parameters during winding on of the film. Naturally, in a standard area also a standard average value can be defined, wherein deviations from the standard average value also approve a regulation, which enables an influence already before leaving the standard area. Thereby, it can be counter steered that the value for the roll hardness leaves the standard area at all.

Advantageously it is further when with a method according to the invention a step for the submission of at least one operation parameter is performed, which influences the winder quality. Thereby, these operation parameters are configured particularly in a specific manner related to the dimension of the film of the film roller. The submission of operation parameters permits an alteration of the target for winding on a manual, semi automatic or even as a control part in a full automatic manner. This alteration of targets allow an influence and therewith an alteration of the to be determined roll hardness. Particularly, this submission of operation parameters occurs in a specific manner. Thereby, a reference to geometric dimensions of the film is to be understood. For example, web tensions are indicated by a contact roller or the winder roller to the film not longer in an absolute manner like as a force N but in a specific manner related to the cross section area of the film namely in $N/mm^2$. A contacting force of a contacting roller is correspondingly no longer absolutely indicated as a force N, but as a contact force in a specific manner in N/mm related to the width of the film. The application of specific operating parameters permits to uniquely pretend these and thereby continuously use these for different film applications. The unique specification of specific operation parameters can correspondingly be understood as a semi automatic adjustment of the winding on process. Depending on the film magnitude or the geometric dimension a corresponding control device can use these specific operation parameters in order to adjust the actual absolute values for the contacting force and tension web in the winding on device.

Moreover, it is an advantage when with the method according to the invention the determined winder quality and/or the determined deviation as an input parameter for the regulation of at least one operation parameter is used, which influences the winder quality. Particularly, it comprises at least one of the following operation parameters:

tension web contact roller tension web winder roll contact pressure contact roller By a regulation thus particularly an automatic feedback between the winder quality and the operating parameter has to be understood. The contact roller serves with a winding on device for the generation of the contact pressure during the winding on process against the outermost film layer of the film roll. The tension web within the film is provided by one of both rolls, thus the contact roller on the one hand and the winder roller on the other hand. Each of these two tension webs combined generates the complete tension web in the film so that for the tension web of the film two different operation parameters namely the tension web by the contacting roller and the tension web by the winder roller are adjustable. Here particularly specific parameters are used in order to further reduce the regulation effort like described in the previous paragraph. By the use of a method according to the invention for the regulation of the operating parameters a desired winder quality can be achieved with a high guaranty. Deviations are recognized in time and reduced by an automatic readjustment so that as a result of the winding on process of a film roller results with a winder quality in a defined standard area.

Another advantage is achieved when with the method according to the invention for the regulation of the at least one operation parameter the radial pressure flow is respected during the winding on of the film roller. Thereby, it has to be pointed out that by the winding on of a plurality of film layers on top of each other the outermost film layers further influence the inner film layers. This has to be compared with rubber bands, which are lying on top of each other on a winder roll. So the outermost film layers perform an additional force to the innermost film layers. This causes that air cushions between the inner film layers are reduced during the process of winding on since by the arisen pressure force from the outside air is pushed out of these air cushions. Therewith the final roll hardness distinguishes in the interior of the film roller from the roll hardness which was determined during the respective wind on time point of this inner layer. At this point in time the inner layers were the outermost layer of the film roller. In a control technique advantageously a consideration of the adjusted pressure flow is deposited which considers film weight, film cross section or further parameters. The consideration of the pressure flow can thereby be used for the regulation in order to adjust the exact radial pressure flow or an exact radial flow of roll hardness across the film roll. Particularly, at the beginning it is particularly wound up strongly in order to provide subsequently a sufficient resistance of these subsequently developing inner film layers.

It is also an advantage when with the method according to the invention in a direction transverse to the winding on direction of the film an at least twice sectional determination of the roll hardness of the film roller occurs during the wind on of the wind roll. The section wise collection can be provided by high resolution sensors, which are distributed across this cross direction. Likewise, a mechanical movement of the sensor in traversing manner is possible according to this embodiment and the invention. An axial resolution of the roll hardness particularly yields the advantages concerning the avoidance of the problem of compression rings. Therewith a method according to the invention can be further established in order to ensure the security of the compliance of the winder quality also over the axial flow of the film roller.

Further, it is an advantage when with the method according to the invention in the direction transverse to the wind on direction of the film particularly across the width of the film the roll hardness and/or the production profile of the film is kept constant or mainly constant by the regulation of at least one operation parameter. In this matter also in width direction meaning mainly parallel to the axis of rotation of the film roller an equalisation of the winder quality is achieved. With other words therewith a mainly even winder profile can be generated.

A method according to the invention can be further developed in the way that on basis of a certain winder quality and/or the certain deviation an alteration of a production profile of the films a previous production process is performed. Thereby it is particularly about an extrusion process of a film preferably a blown film extrusion process. A processing of the film, particularly a reversing of the film, can be resigned, particularly by an intervention possibility into the regulation of the film profile. Beneath the necessary costs for a reversing device in this manner also construction space can be saved. Preferably such an embodiment of the method occurs in combination with a section wise monitoring profile in an axial direction, so that a corresponding regulation of the defined sections of the film profile becomes possible. Further, it is possible to complement this course of action with a sum profile regulation.

A further embodiment of the present invention is a monitoring device for monitoring of the winder quality of the film roll of the film of the winder roll comprising at least one sensor device. This at least one sensor device is configured for the determination of the roll hardness of the film roll during the winding on of the film on the winder roll. Further, a monitoring device according to the invention comprises a control device, which is configured for the determination of a deviation of the certain roll hardness of the film roll of at least one standard value for the roll hardness of the film roll. Further, a control device is configured for the determination of the winder quality of the film roll by means of a certain deviation. It is an advantage when the monitoring device according to the invention comprises a control device for the performance of a method according to the invention. Accordingly, a monitoring device according to the invention comprises the same advantages like described in detail regarding the method according to the invention.

The method according to the invention can be used in order to simplify complex operations of recent winder machines. The previous manual presetting of the winder parameter is complimented by a semi automatic and/or fully automatic user possibility. For experienced operating personal it can be reasonable to use the own experience knowledge in order to determine regular station points for the semi automatic and/or the full automatic operation level. Therefore the control device is preferably configured in a way that the semi automatic and the full automatic method can be actuated and deactivated in simple manner in every production phase directly from the user.

BRIEF DESCRIPTION OF THE SEVERAL VIEWS OF THE DRAWINGS

Further advantages, features and details of the invention result from the subsequent description in which embodiments of the invention are described in detail regarding the drawings. Thereby, the features described in the claims and the description can be individually or in any combination be essential for the invention. It is schematically shown:

DESCRIPTION OF SPECIFIC EMBODIMENTS OF THE INVENTION

Figure 1:
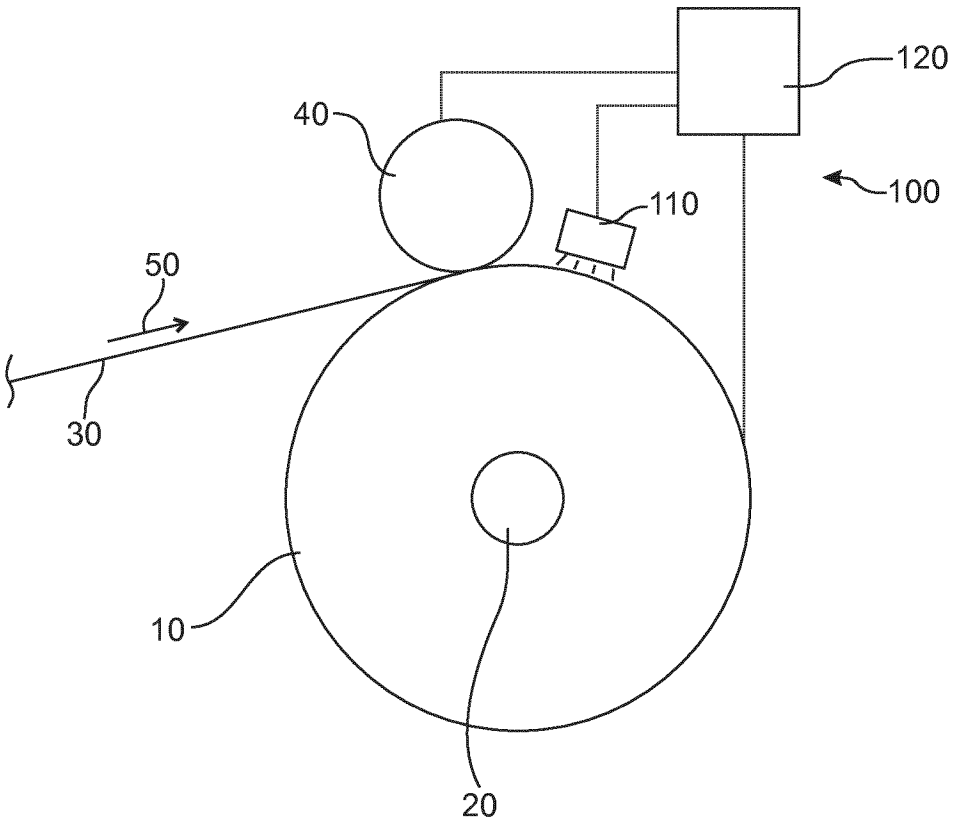
FIG. 1 an illustration of the monitoring device according to the invention

The FIG. 1 shows schematically a winding on device with a winder roll 20 on which a film roll 10 is produced. Hereby the winder roll 20 is rotated and a film 30 is wound on the winder roll 20. In order to ensure a clean winding process a contact roller 40 is intended, which performs a corresponding contact pressure AD to the film roll.

Like it is recognized in FIG. 1 a monitoring device 100 is intended. This is configured with a sensor device 110 and a control device 120. This sensor device 110 is configured in order to determine the roll hardness and the course of the winding on process at least in the uppermost layer of the film 30. This determination occurs particularly contact-free for example using ultra sonic measurement. Further, the control device 120 can be configured for the regulation of the operation parameter. This is shown by the dotted connection lines between the control device 120 and the winder roller 20 and the contact roller 40.

Figure 2:
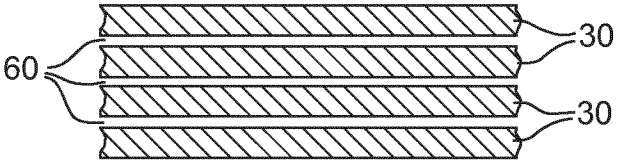
FIG. 2 different layers of the film with a first size of an air space
Figure 3:
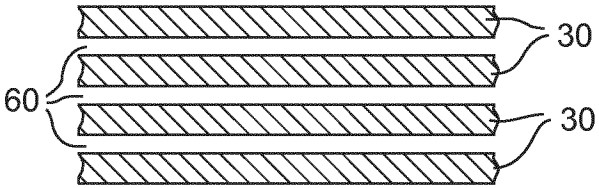
FIG. 3 different layers of a film with a second size of an air space

During the winding on of the film 30 as the film roller 10 on the winder roll 20 different air space sizes as air spaces 60 are produced between the film layers of the film 30 according to the adjustment of the operation parameter. FIG. 2 shows a first embodiment of a film roller 10 wherein the film layers comprise relatively small air spaces 60 between themselves. This correlates to a relative hard embodiment concerning the roll hardness WH of the film roller 10. FIG. 3 shows greater air spaces 60 between the single films 30 so that correspondingly also a softer roll hardness WH of the corresponding film roll 10 is adjusted. The influence sizes, which lead to different intense roll hardness WH will be subsequently described in detail regarding FIG. 6.

Figure 4:
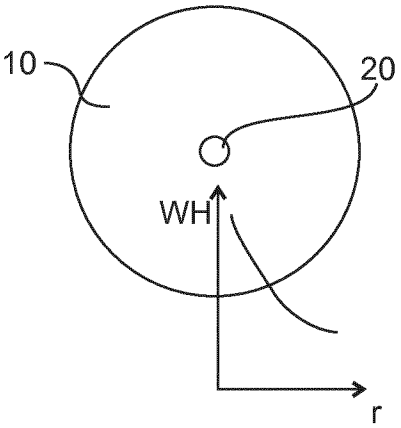
FIG. 4 a schematic drawing of a radial process of the roll hardness

In FIG. 4 it is schematically shown that the course of the roll hardness WH does not have to be constant in radial direction of the film roll 10. It is rather possible that the roll hardness WH in the inner of the film roll 10 meaning around the radial area of the film roll 20 is significantly greater than in the outermost film layer area of the film roll 10. Therewith the subsequent processing can be influenced or the adjusted pressure course in radial direction of the film roll 10.

Figure 5:
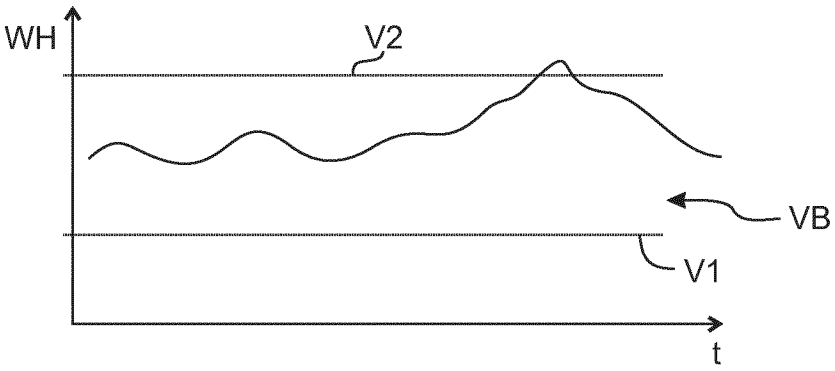
FIG. 5 an illustration of the temporal course of the determination of the roll hardness FIG. 6 a schematic drawing of the intervention size of the operation parameter on the film

FIG. 5 shows a schematic drawing how a certain roll hardness WH represents over the timely course. Particularly, in this schematic diagram drawing two standard values V1 and V2 can be recognized which define a standard area VB as an upper limit and a lower limit. At the right edge it can be recognized that the determined roll hardness WH exceeds the upper standard value V2. At this point an intervention will occur at the latest in order to again achieve the desired standard area VB. Thereby a regulation of the operating parameters can occur like subsequently described regarding FIG. 6.

Figure 6:
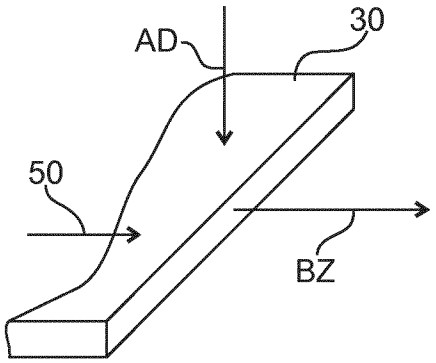

In FIG. 6 the film 30 is schematically shown. The film comprises a width from left down to right up and a corresponding film cross section which can be recognized at the right edge. In the direction of the winding on direction 50 the so called web tension WZ is directed. This web tension WZ is produced by a corresponding winder velocity of a winder roll 20 and the contact roller 40. In summary the web tension WZ results for a film 30, which is directed in winding on direction 50. This can be specifically configured and thereby particularly related to the film cross section in $N/mm^2$. Mainly vertically thereto the so called contact pressure AD from the contact roller 40 acts. This can be configured likewise in a specific manner and relate to the width, in N/mm of the film 30. This parameter can be regulated as controlled value or manipulated value from the input value of the certain roll hardness WH of a method according to the invention.

The previous description of the embodiments describes the present invention exclusively within the scope of examples. Naturally single features of the embodiments as far as technically reasonable can be freely combined to one another without leaving the scope of the present invention.

REFERENCE LIST

10 film roll
20 winder roller
30 film
40 contact roller
50 winding on direction
60 airspace
100 monitoring device
110 sensor device
120 control device
AD contact pressure
BZ web tension
V1 first standard value
V2 second standard value
VB standard area
WH roll hardness
r radial distribution of the film roll
t time response of the determination of the roll hardness

What is claimed is:

1. A method for the determination of the winder quality of a film roll of a film on a winder roller comprising:

determination of the roll hardness of the film roll during the winding on of the film on the winder roller as a measure for the size of air spaces between film layers of the film in a direct manner at the film roll, determination of a variation from the determined roll hardness of the film roll from at least one standard value for the roll hardness of the film roll, determination of the film roll using the determined variation;

wherein only for the two outermost layers the determination of the roll hardness occurs.

2. The method according to claim 1, wherein at least the step of determination of the roll hardness of the film roll occur continuously.

3. The method according to claim 1, wherein the step of determination of the roll hardness of the film roll during the winding on is contactlessly performed.

4. The method according to claim 1, wherein the step of determination of the roll hardness of the film roll during the winding on is performed using at least one of the following methods:

ultra sonic measurement
laser measurement
radar measurement, terahertz, microwaves
contacting track roller.

5. The method according to claim 1, wherein at least two standard values define a standard area as upper standard value and lower standard value.

6. The method according to claim 1, wherein a step for the submission of at least one operating parameter is performed which influences the winder quality wherein these operating parameters are configured according to the dimension of the film of the film roll.

7. The method according to claim 1, wherein at least one of the determined winder quality and the determined variation is used as an input parameter for the regulation of at least one operating parameter which influences the winder quality, at least one of the following operating parameters:

web tension contact roller
web tension winder roller
contact pressure contact roller.

8. The method according to claim 7, wherein during the regulation of at least one operating parameter a radial pressure pattern is considered which adjusts during the winding on of the film roll.

9. The method according to claim 1, wherein in direction transverse to the winding on direction of the film an at least twofold sectional determination of the roll hardness of the film roll occurs during the winding on to the winder roll.

10. The method according to claim 9, wherein in the direction transverse to the winding on direction of the film the roll hardness or a manufacturing profile of the film is kept constant orby the regulation of at least one operation parameter.

11. The method according to claim 1, wherein on the basis of the determined winder quality or the determined variation an alteration of a manufacturing profile of the film is performed in a previous production process.

12. A monitoring device for monitoring of the winder quality of a film roll of a film on a winder roll comprising at least a sensor device for a determination of a roll hardness for only two outermost layers of the film roll during the winding on of the film on the winder roll as a measure for the size of air spaces between film layers of the film in a direct manner at the film roll, further comprising a control device, which is configured for the determination of a variation of the determined roll hardness of the film roll of at least one standard value for the roll hardness of the film roll and the determination of the winder quality of the film roll by means of the determined variation.

13. The monitoring device according to claim 12, wherein the control device is configured that at least the step of determination of the roll hardness of the film roll occurs continuously.

14. The monitoring device according to claim 12, wherein the control device is configured for changing between manual, semi automatic and full automatic operation.

* * * * *